US009017066B2

(12) United States Patent
Adams

(10) Patent No.: US 9,017,066 B2
(45) Date of Patent: Apr. 28, 2015

(54) MULTIPLE ACTIVATION CONTACT LIGHTER

(75) Inventor: Paul H. Adams, Monroe, CT (US)

(73) Assignee: Zippo Manufacturing Company, Bradford, PA (US)

( * ) Notice: Subject to any disclaimer, the term of this patent is extended or adjusted under 35 U.S.C. 154(b) by 385 days.

(21) Appl. No.: 13/093,078

(22) Filed: Apr. 25, 2011

(65) Prior Publication Data

US 2012/0270163 A1 Oct. 25, 2012

(51) Int. Cl.
*F23Q 7/12* (2006.01)
*F23Q 2/28* (2006.01)

(52) U.S. Cl.
CPC ..... *F23Q 2/287* (2013.01)

(58) Field of Classification Search
CPC ..... F23Q 2/287; F23Q 2/34; F23Q 2/164; F23Q 3/002; F23D 11/36
USPC ..... 431/255, 153, 254; 222/162, 182, 222/153.14
See application file for complete search history.

(56) References Cited

U.S. PATENT DOCUMENTS

| | | | | |
|---|---|---|---|---|
| 524,054 | A * | 8/1894 | Brooks | 431/153 |
| 5,865,614 | A * | 2/1999 | Hsu | 431/255 |
| 5,897,308 | A | 4/1999 | Saito | |
| 6,093,017 | A * | 7/2000 | Saito et al. | 431/153 |
| 6,244,858 | B1 | 6/2001 | Wang | |
| 6,666,679 | B1 | 12/2003 | Ye | |
| 7,364,427 | B2 * | 4/2008 | Huang et al. | 431/129 |
| 7,581,947 | B2 | 9/2009 | Shan | |
| 2002/0197576 | A1 * | 12/2002 | Xu | 431/153 |
| 2003/0022120 | A1 | 1/2003 | Liang | |
| 2006/0286496 | A1 | 12/2006 | Tu | |
| 2007/0020569 | A1 | 1/2007 | Hsu | |
| 2008/0070173 | A1 * | 3/2008 | Sgroi et al. | 431/153 |

FOREIGN PATENT DOCUMENTS

| | | |
|---|---|---|
| CN | 101216181 | 7/2008 |
| CN | 101334173 | 12/2008 |

OTHER PUBLICATIONS

International Search Report dated Apr. 13, 2012.
Chinese Patent Apln. No. 201180070441.3 office action dated Oct. 8, 2014.

* cited by examiner

*Primary Examiner* — Kenneth Rinehart
*Assistant Examiner* — Bao D Nguyen
(74) *Attorney, Agent, or Firm* — Bachman & LaPointe, P.C.

(57) ABSTRACT

The present invention relates to a lighter. The lighter includes a housing having a supply of fuel, an activating unit movably associated with the housing to selectively ignite the fuel, and at least two separate contact areas such that the user can apply enough force or torque with at least two fingers to overcome the torque/forces required to activate piezo, release the fuel the flame in which the activating unit has at least one internal surface.

29 Claims, 15 Drawing Sheets

MULTIPLE ACTIVATION CONTACT LIGHTER

TECHNICAL FIELD

The present invention generally relates to lighters such as pocket lighters used to light cigarettes and cigars, or utility lighters used to ignite candles, barbecue grills, fireplaces and campfires, and more particularly to such lighters which resist inadvertent operation or undesirable operation by unintended users.

BACKGROUND OF THE INVENTION

Lighters used for igniting tobacco products, such as cigars, cigarettes, and pipes, have developed over a number of years. Typically, these lighters use either a rotary friction element or a piezoelectric element to generate a spark near a nozzle which emits fuel from a fuel container. Piezoelectric mechanisms have gained universal acceptance because they are simple to use. U.S. Pat. No. 5,262,697 to Meury discloses one such piezoelectric mechanism, and the disclosure in the '697 patent is incorporated by reference herein in its entirety.

Lighters have also evolved from small cigarette or pocket lighters to several forms of extended or utility lighters. These utility lighters are more useful for general purposes, such as lighting candles, barbecue grills, fireplaces and campfires. Earlier attempts at such designs relied simply on extended actuating handles to house a typical pocket lighter at the end. U.S. Pat. Nos. 4,259,059 and 4,462,791 contain examples of this concept.

Many pocket and utility lighters have had some mechanism for resisting undesired operation of the lighter by young children. Often, these mechanisms are on/off switches which may shut off the fuel source or may prevent movement of an actuator, such as a push-button, on the lighter. On/off switches which a user positively moves between "on" and "off" positions can be problematic. For example, an adult user may forget to move the switch back to the "off" position after use and thereby render the feature ineffective.

Other pocket and utility lighters include a spring-biased blocking latch which arrests or prevents movement of the actuator or push-button. U.S. Pat. No. 5,697,775 to Saito and U.S. Pat. No. 5,145,358 to Shike, et al., disclose examples of such lighters.

There remains a need for lighters which resist inadvertent operation or undesirable operation by unintended users, that is easy to manufacture, has a minimal number of components and that is consumer-friendly for the intended user, and it is the focus of the present invention to meet this need.

SUMMARY OF THE INVENTION

In accordance with the present invention, the foregoing needs and object have been met. According to the invention, a lighter design is provided which reduces the number of components required to make the lighter child resistant to the quantity that was used in lighters prior to increasing the efforts to improve the child resistancy of lighters. This lighter design significantly reduces cost and complexity while providing a lighter which is both child resistant and user friendly to those who are adults, and thereby, intended users.

The present invention relates to a lighter, such as a pocket lighter or a utility lighter. a housing having a supply of fuel; an ignition mechanism for igniting fuel from the supply of fuel; an activating unit movably associated with the housing to selectively ignite the fuel upon application of an activating force to the activating unit; and at least two separate contact areas exposed through the housing to allow a user to use at least two fingers to apply forces to the contact areas which combined are greater than or equal to the activating force.

The two separate contact areas of the activating unit may be exposed through different portions or sides of the housing which can be on opposite sides of the housing. The activating unit can be made as a one-piece activating member and is moveably associated with the housing such that application of the force to the separate contact areas moves the activating member relative to the housing to selectively ignite the fuel.

The activating unit can alternatively be an activating assembly comprising a plurality of components at least one or more of which can be moveably associated with the housing to allow operation of the lighter through application of the required activating forces. Thus the activating unit can be a one-piece activating member or an actuating assembly comprising a plurality of parts.

The lighter may also have an extended nozzle as in a typical utility lighter and the nozzle is connected to the fuel supply. The fuel supply feeds fuel to the extended nozzle, typically through a tube. When the activating unit is moved or rotated, the internal surfaces of the activating unit interact with the gas release mechanism to release fuel, and interact with the ignition or spark generating member to create a spark so that the fuel may be ignited. The interaction can be direct or indirect as there could be a component between the cam and the piezo and or gas release mechanism.

The force required to move the activating unit to ignite the fuel can be a combination of the forces required to release the gas and activate the spark generating member. The force to move the activating unit can also be increased by adding an additional force imposing member, such as at least one spring that is opposing the movement of the activating unit, as well as return the activating unit to its initial position.

In addition to the possibility of adding an additional force imposing member to increase the necessary activating force, the activating force can also be adjusted to positioning of the contact areas relative to the pivot point, whereby the length of the lever for application of the ultimate force to the activating unit can be adjusted to make it easier or harder to activate the lighter.

A first contact area of the activating unit can be located on the bottom of the housing and the second contact area on a different portion of the handle. The second contact area is preferably located on the top portion of the handle. The activating unit can be moved from a first, initial or off position to a second or ignited position and when the activating unit is moved to the ignited position the lighter may ignite the fuel supplied from the fuel supply.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
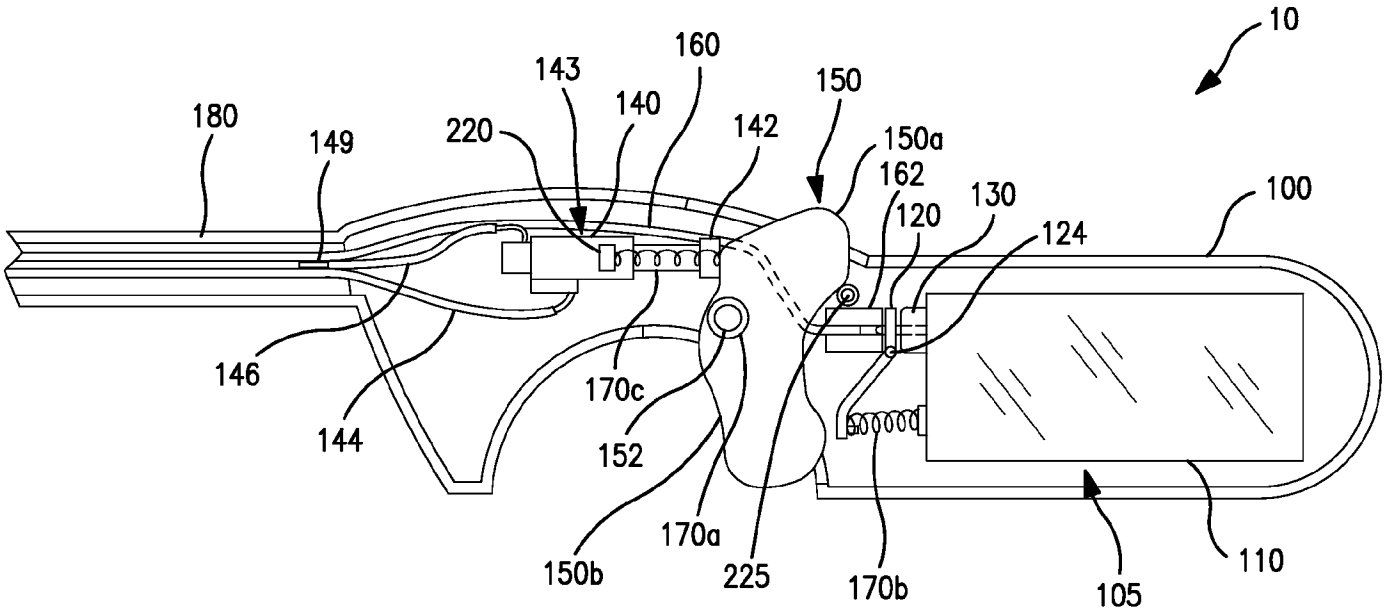
FIG. 1 is a cut-away, side view of a utility lighter of one embodiment with some components removed for clarity and better illustrating various inner details, wherein the lighter is in an initial position.

Turning to FIG. 1, an embodiment of a utility lighter 10 constructed in accordance with the present invention is shown with the understanding that those of ordinary skill in the art will recognize many modifications and substitutions which may be made to various elements. While the invention will be described with reference to a utility lighter, one of ordinary skill in the art could readily adapt the teaching to conventional pocket lighters and the like.

The utility lighter 10 of FIG. 1 and other embodiments herein provide a utility lighter which is designed to have features to prevent or discourage (or increase the difficulty of) lighting by unintended users.

Utility lighter 10 has a housing 100 having a handle at one end and a nozzle 230 (FIG. 1B) at another end and including a fuel supply 110 connected for selective fluid communication with nozzle 230. An igniter assembly generally shown at 143, such as a piezoelectric mechanism, is operatively connected to housing 100 for generating a spark proximate nozzle 165 (FIG. 1B) and an actuating unit shown in this embodiment as cam 150 is connected to housing 100 proximate to the handle and can be operated to both dispense fuel from fuel supply 110 and to activate igniter assembly 143.

Housing 100 may be formed primarily of molded-rigid-polymer or plastic materials such as acrylonitrile butadiene styrene (ABS) or the like. Housing 100 may also be formed of two-parts that are joined together by techniques known by those of ordinary skill in the art, such as ultrasonic welding.

Figure 1A:
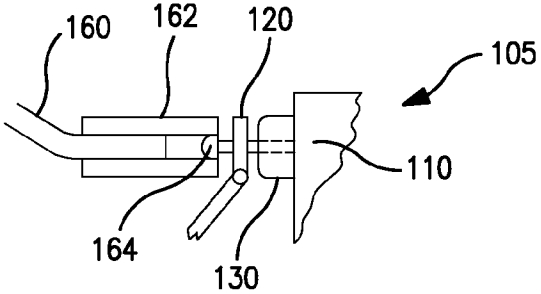
FIG. 1A is a detail view of the connection between the fuel supply and the tube and a portion of the gas actuator.
Figure 2:
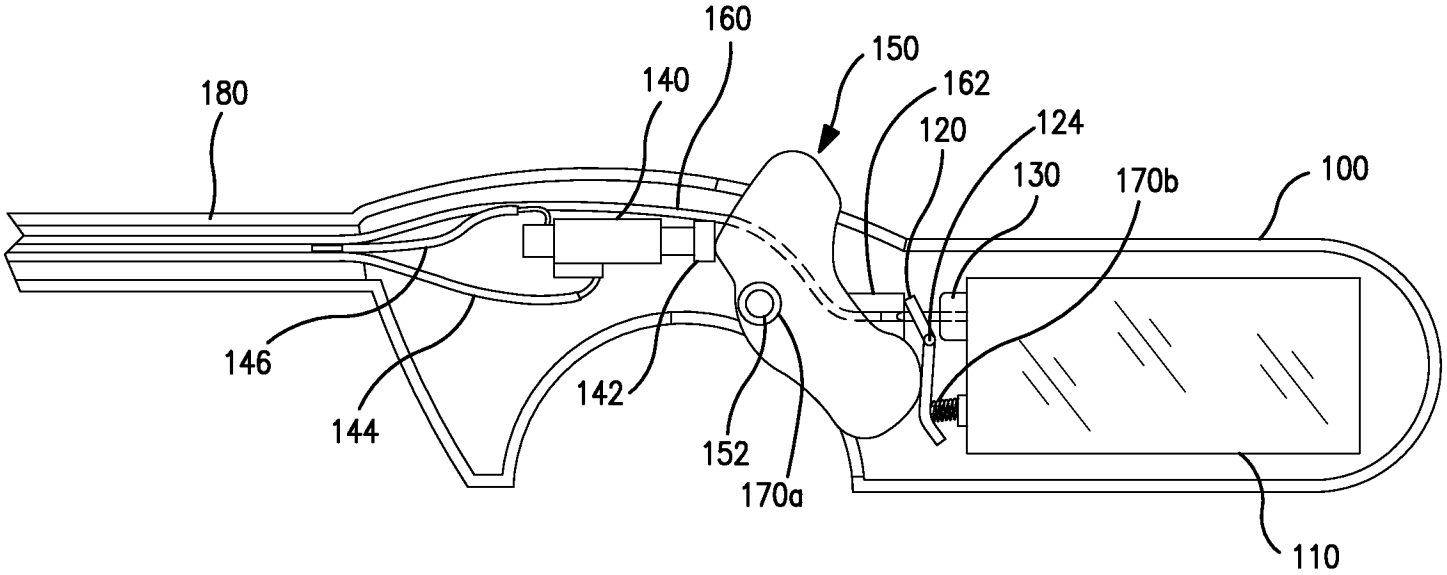
FIG. 2 is a cut-away, side view of the utility lighter of FIG. 1 wherein the lighter is in an ignition state.
Figure 3:
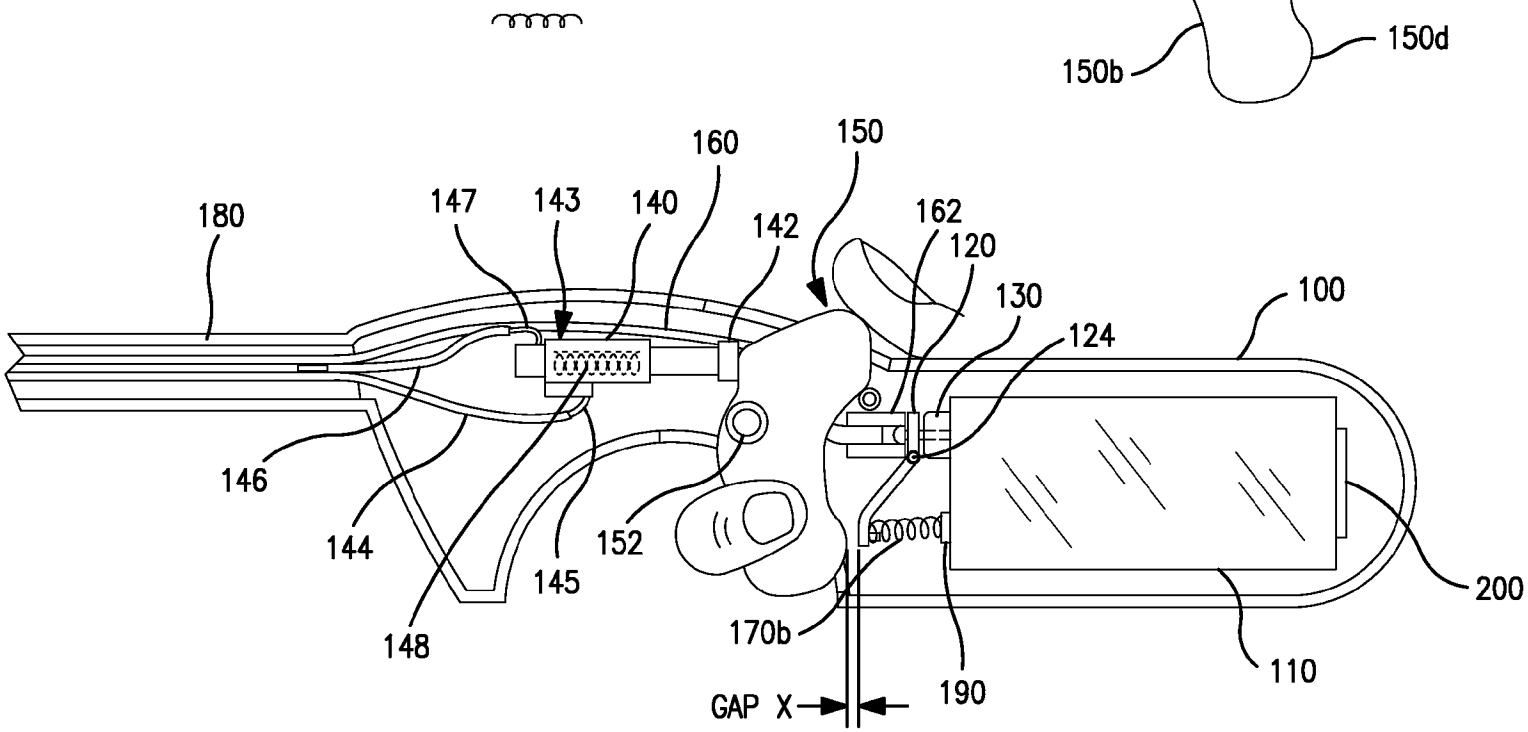
FIG. 3 similar view to FIG. 1 with the addition of the users fingers located on the two separate activating points on the activating unit at the start of the ignition process.
Figure 4:
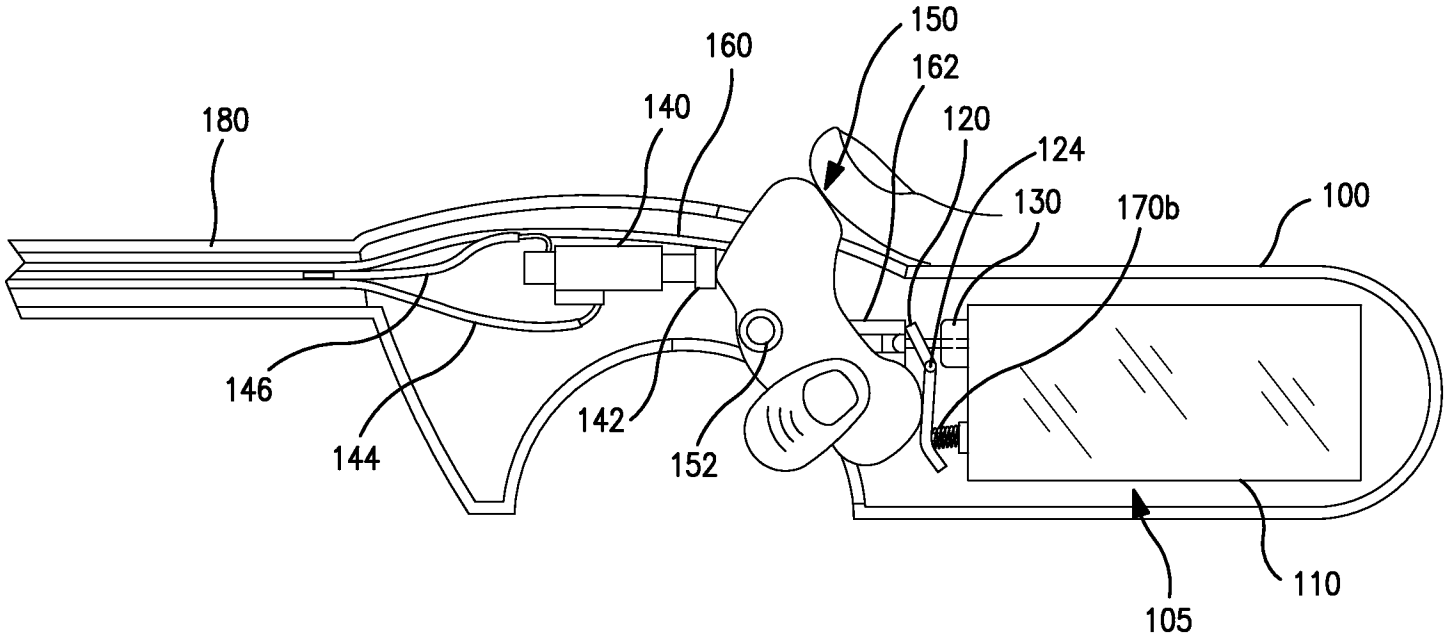
FIG. 4 is a similar view to FIG. 2 with the addition of the users fingers located on the two separate activating points on the activating unit at the point of ignition.

Referring to FIGS. 1 thru 4, housing 100 preferably contains a fuel supply unit 105 (FIGS. 1 & 1A) that includes fuel supply container 110, a gas actuator 120, and a valve assembly 130 which is connected to a tube 160 that extends through a wand 180 to a tip or nozzle 230 of the wand. The fuel supply container 110 contains fuel, which may be compressed hydrocarbon gas, such as butane or propane and butane mixture, or the like. Retainers 190 and 200 as shown in FIGS. 3 & 4 can be positioned within the housing 100 to properly position and hold fuel supply 110 with respect to gas actuator 120.

Figure 1B:
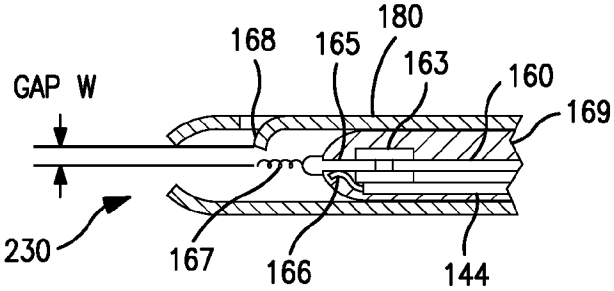
FIG. 1B is a detail view of the end of the extended nozzle where ignition takes place.

Referring to FIGS. 1, 1A & 2, gas actuator 120 is rotatably supported on or connected to housing 100 or to fuel supply 105. Valve assembly 130 includes a jet 164 (FIG. 1A) and valve. The valve can be an adjustable or fixed flame valve and can be a normally open or normally closed valve design as known in the art. Rotation of the gas actuator 120 in the counter-clockwise direction lifts jet 164 releasing fuel from fuel supply 105.

Referring to FIGS. 1, 1A, and 2, a fuel connector 162 is disposed on top of jet 164 and receives a tube 160 therein. The connector 162, however, is optional and if not used the tube 160 can be disposed on jet 164 directly.

Suitable fuel supply containers 110 are disclosed in U.S. Pat. Nos. 5,934,895, 5,520,197, 5,435,719 and 6,086,360 the disclosure of which is incorporated herein by reference in its entirety. The fuel supply units disclosed in the above patents can be used with all of the disclosed components or with various components removed, such as windshields, latch springs, latches, and the like, as desired by one of ordinary skill in the art. Alternative arrangements of the fuel supply unit can also be used.

Tube 160 defines a channel for fluidly connecting fuel supply unit 110 to nozzle 165 (FIGS. 1, 1A & 1B). A suitable material for flexible tube 160 is plastic. Tube 160 thus transports fuel from fuel supply unit 105 to nozzle 165.

Tube 160 is connected to nozzle 165 located adjacent to tip 230 of extended nozzle or wand 180. Tube 160 thus conveys fuel from fuel supply unit 105 to nozzle 165 at tip 230 of wand 180. Nozzle 165 may optionally include a diffuser 167, preferably in the form of a coil spring as shown in FIG. 1B.

Referring to FIG. 1, although not necessary for all aspects of this invention, an electric ignition assembly 143 such as a piezoelectric mechanism is one preferred ignition assembly. The ignition assembly may alternatively include other electronic ignition components, such as shown in U.S. Pat. Nos. 3,758,820 and 5,496,169, a spark wheel and flint assembly or other well-known mechanisms in the art for generating a spark or igniting fuel. The ignition assembly may alternatively include a battery having, for example, a coil connected across its terminals. The piezoelectric mechanism may be the type disclosed in the '697 patent mentioned above.

The piezoelectric unit 143 preferably includes an upper portion 140 and a lower portion 142 that slide with respect to each other along a common axis. A coil spring or piezo spring 148 is positioned between the upper and lower portions 140, 142 of the piezoelectric unit. Piezo spring 148 serves to resist the compression of piezoelectric unit, and when positioned in housing 100 resists rotation of cam 150.

Piezoelectric unit 143 (FIG. 3) further includes electrical contact 145 and electrical contact 147. Wire 146 connects electrical contact 147 to wand 180. Wire 144 connects electrical contact 145 to nozzle 165 (shown in FIG. 1B). When piezo electric unit 143 is activated a spark is generated across gap Y (FIG. 1B) to ignite fuel.

Referring to FIGS. 1-4, cam 150 is preferably rotatably supported on the housing 100. One of ordinary skill in the art can readily appreciate that cam 150 also may be coupled or connected to the housing in another manner such as in a cantilevered fashion, bendably, slidably or rotatably. For example, cam 150 can be a linkage system or formed of two pieces, where one piece is slidably coupled to housing 100 and the other piece pivots. Such an embodiment is shown in FIG. 10 discussed below.

Figure 2A:
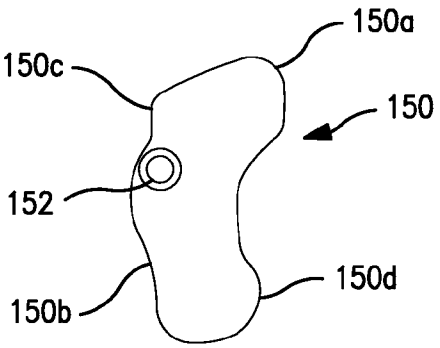
FIG. 2A is a detail view of the cam 150 from lighter in FIG. 1 defining the different surfaces of the cam.

The shape of cam 150 can take any shape that has at least 2 exposed surfaces (150*a* & 150*b*, FIG. 1) and at least one functional surface that directly or indirectly (such as 150*c* or 150*d*, FIG. 2A) interacts with the ignition assembly and/or fuel supply. In this embodiment, cam 150 has two activating points; namely an upper exposed contact surface 150*a* that is located on the upper portion of cam 150 which is exposed through the housing 100 on a top portion of the housing and a lower exposed contact surface 150*b* exposed through the lower portion of the housing 100 which is also extending beyond the housing 100. The two activating points allow an adult user to apply forces at 2 locations with 2 different fingers. As cam 150 rotates about cam pivot 152, gas actuator contact surface 150*d* closes gap X between surface 150*d* and gas activator 120 (FIG. 3) and then applies the forces/displacements to gas actuator 120 to rotate and release fuel. The fuel travels through tube 160 to nozzle 165. During the time of gas release, piezo contact surface 150*c* compresses piezo electric mechanism 143 causing a hammer (not shown) within the piezoelectric unit to strike a piezoelectric element (not shown), also within the piezoelectric unit 143. Striking of the piezoelectric element or crystal, produces an electrical impulse that is conducted thru wires 144 & 146 (as shown in FIGS. 1-4) to wand 180 to wand antenna 168 (FIG. 1B) to create a spark gap W with nozzle 165 or diffuser 167. An electrical arc is generated across the gap W between nozzle 165 or diffuser 167 and wand antenna 168, thus igniting the fuel released from the fuel supply.

Alternatively, the actuating unit may perform one of the fuel release and/or ignition function, and another mechanism or assembly may perform the other function.

It is within the broad scope of the present invention to have cam 150 or other embodiments of the actuating unit of the present invention operate either or both of the fuel release and ignition functions. In the embodiment shown in FIGS. 1-4, cam 150 actuates both of these functions. It should be readily apparent to a person skilled in the art, however, that the function of cam 150 as a deterrent to operation by unintended users could also be met by operation of either of these functions through the cam, with the other function being operated by a different mechanism, as both functions are required to generate ignition. For example, in such embodiments, cam 150 could operate only the igniter assembly 143, and some other control structure could be positioned on lighter 10 to control fuel supply.

Thus, any combination of the ignition and fuel supply functions can be controlled by the actuating unit in accordance with the broad scope of the present invention. It is preferred, however, to have the actuating unit control both of these functions.

The cam 150 for this embodiment can be is preferably an injection molded plastic component molded from thermoplastic materials such as acrylonitrile butadiene styrene (ABS), polypropylene, nylon, acetal, etc. or a die cast component cast from zinc (Zamak 3) or aluminum, etc.

Alternatively, cam 150 can be part of a multiple piece assembly such that the activating unit can be a multiple component assembly if desired, some or all of which may move relative to housing 100 and/or cam 150 to produce ignition as desired.

Alternatively, cam 150 can be produced with multiple materials such that the upper and lower activation surfaces 150*c* & 150*d* are covered with thermoplastic elastomer (TPE) to increase comfort for the intended user.

Referring to FIGS. 1 and 2, lighter 10 can include springs to create the predetermined activation force required to activate the lighter by rotating cam 150. Preferably, piezo spring 148 within piezo 143 and coil spring 170*b* are the only springs in the preferred embodiment so as to minimize the parts required.

Optionally, additional springs such as torsion spring 170*a* at pivot point 152 and/or spring 170*c* or the like can be added to create a different predetermined activative force. The predetermined force can also have a non-linear spring rate such that the force to rotate the cam 150 can change throughout the rotation if desired.

Torsion spring 170*a* can be located between housing 110 and cam 150. Torsion spring 170*a* is preferably manufactured from a metal having resilient properties, such as spring steel, stainless steel, or from other types of materials.

Spring 170*c* can be located between cam 150 and protrusion 220 on housing 100. Spring 170*c* can be a coil spring manufactured from a metal having resilient properties, such as spring steel, stainless steel, or from other types of materials such as an acetal thermoplastic. It should be noted that while spring 170*c* is shown mounted relative to protrusion 220 on the lighter housing 100 it may alternatively be coupled to other components of the lighter. In addition, coil spring 170*b* may be a tension or compression coil spring, or can be replaced with a leaf spring, a cantilever spring or any other biasing member suitable for biasing cam 150. Protrusion 220 may also have side walls, a pin or some other structure located on one surface of protrusion 220 that secures one end of spring 170*b* to prevent the spring from moving on protrusion 220 during rotation of the cam 150. Cam 150 may also have a recess (circular), or some other suitable structure to help maintain the other end of spring 170*b* in the desired position on cam 150 during rotation of cam 150.

Spring 170*c* can also be a variable spring rate spring to increase the force at a predetermined position, and this can be done to produce non-linear resistance to activation as described above. One predetermined position could be that the spring rate increases just prior to activation of the piezo. This can be accomplished by placing springs inside of each other, such that when the compressed height reaches the smaller spring the spring rate will be increased or a progressive rate coil spring can be used Referring still to FIG. 1, housing pin 225 can be connected to the housing 100 and positioned to prevent cam 150 from rotating in a clock-wise direction when cam 150 is in its initial position. Cam 150 is in its initial position when cam 150 is in contact with housing pin 225. Piezo spring 148, springs 170*a* and/or 170*c* can be designed to apply a force to cam 150 to cause cam 150 to return to the initial position and create a preloaded force that the end user must overcome as part of the activating force prior to being able to rotate cam 150 from its initial position.

Coil spring 170*b* is located between gas actuator 120 and rib retainer 190 on housing 100. Coil spring 170*b* is preferably manufactured from a metal having resilient properties, such as spring steel, stainless steel, or from other types of materials such as an acetal thermoplastic. It should be noted that while coil spring 170*b* is shown mounted against housing 100, it may alternatively be coupled to other components of the lighter.

Piezo spring 148, torsion spring 170*a*, coil spring 170*b* and/or spring 170*c*, can be adjusted to create a force difficult enough for unintended users to activate while adults can use two fingers such as their index finger and thumb to overcome the force necessary to ignite the lighter. The combined force on the exposed contact surfaces to ignite the gas should be less than 20 kg and greater 5 kg, preferably less than 15 kg and greater than 6.5 kg. In terms of torque, this could be adjusted by adjusting a lever length between contact areas of cam 150.

This embodiment (lighter design) is also inherently tamper-resistant. If cam 150 is removed from the lighter, the lighter is then non-functional and cannot be operated because all the required surfaces to release the gas and activate the ignition mechanism would be removed from the product.

Surfaces 150*c* and 150*d* can be designed to control the time in the rotation or angle of rotation at which fuel is released and the piezo mechanism is activated, by positioning the surfaces 150*d* and 150*c* relative to the piezo and/or fuel release components to engage where desired. The location of piezo mechanism 143, gas actuator 120, springs (170*a*, 170*b* & 170*c*) in relation to the cam pivot 152 and the force to activate the piezo mechanism 143, depress the gas actuator 120 to release gas, and rotate the cam to overcome the forces from springs (170*a*, 170*b* & 170*c*) plus any frictional forces combine to determine the force/torque to rotate cam 150 to ignite the fuel. When the user wants to extinguish the flame, releasing the activating unit allows internal springs to pivot cam 150 back to the starting or rest position, which stops the flow of gas from fuel supply unit 105 and thereby extinguishes the flame.

Thus, the embodiment of FIGS. 1-4 presents a lighter 10 which has internal springs resisting actuation of the lighter to a desired force so as to discourage operation by unintended users. In the meantime, cam 150 is configured to have two different actuating surfaces, namely surfaces 150*a* and 150*b*, such that two fingers can be used to overcome the forces in opposition to ignition of the lighter, and thereby ignite fuel. FIG. 1 shows lighter 10 of this embodiment in a rest position, wherein cam 150*d* is positioned spaced away from the gas actuator 120 by a gap, and wherein cam surface 150*c* is proximate to but not operating igniter assembly 143. FIG. 2 shows the same lighter having been moved to the ignition position, wherein cam 150 is pivoted counter-clockwise, cam surface 150*d* is depressing gas actuator 120 to release fuel, and cam surface 150*c* is operating igniter assembly 143. FIGS. 3 and 4 show the same positions of lighter 10 as FIGS. 1 and 2, but show an intended location of a user's fingers to apply force to surfaces 150*a* and 150*d* as desired.

Figure 6:
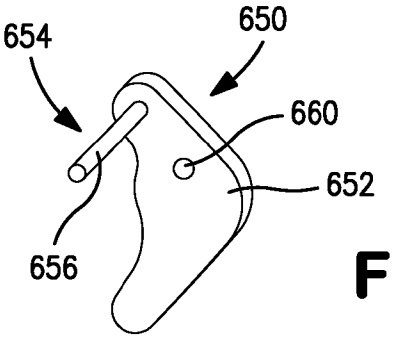
FIG. 6 is the activating unit of the embodiment of FIG. 5.
Figure 5:
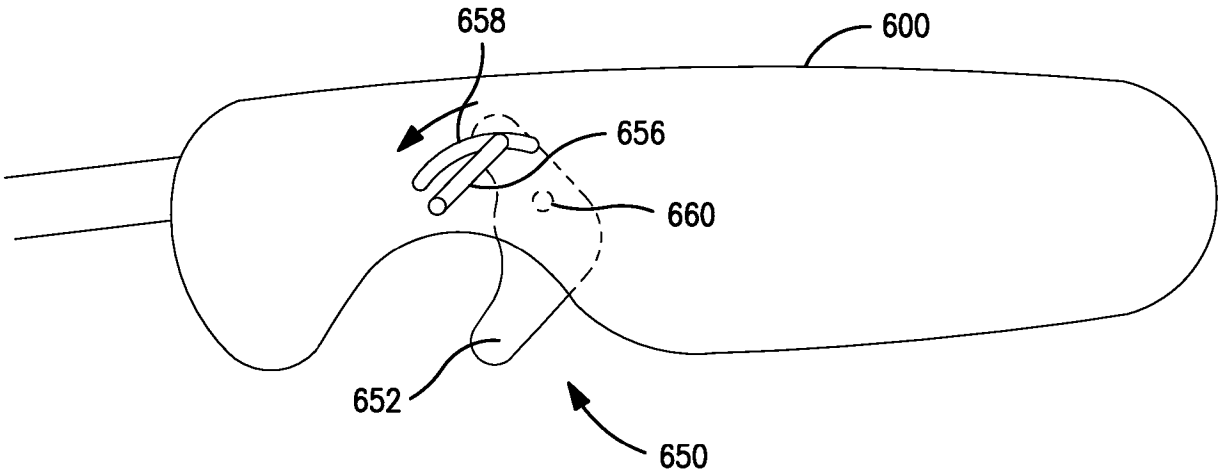
FIG. 5 shows an alternate embodiment configuration of the activating unit wherein the activating points are on the side and the bottom of the housing in the initial position.

FIGS. 5-9 show a further embodiment of the present invention wherein the actuating unit is different in structure as compared to cam 150 of FIGS. 1-4. In the embodiment in FIGS. 5-9, the actuating units comprises an assembly 650 of a cam 652 and an extension 654, in this case a laterally extending rod 656 which is fixed to cam 652 and positioned to extend out of housing 600 through a slot 658 in housing 600. As shown by the arrow in FIG. 5, rod 656 provides another surface to which force can be applied by an intended user to provide the combined activating force needed to operate the lighter. FIG. 5 shows alternate activating assembly 650 within the lighter, which FIG. 6 shows assembly 650 removed from housing 600 to further illustrate the detail thereof.

Figure 7:
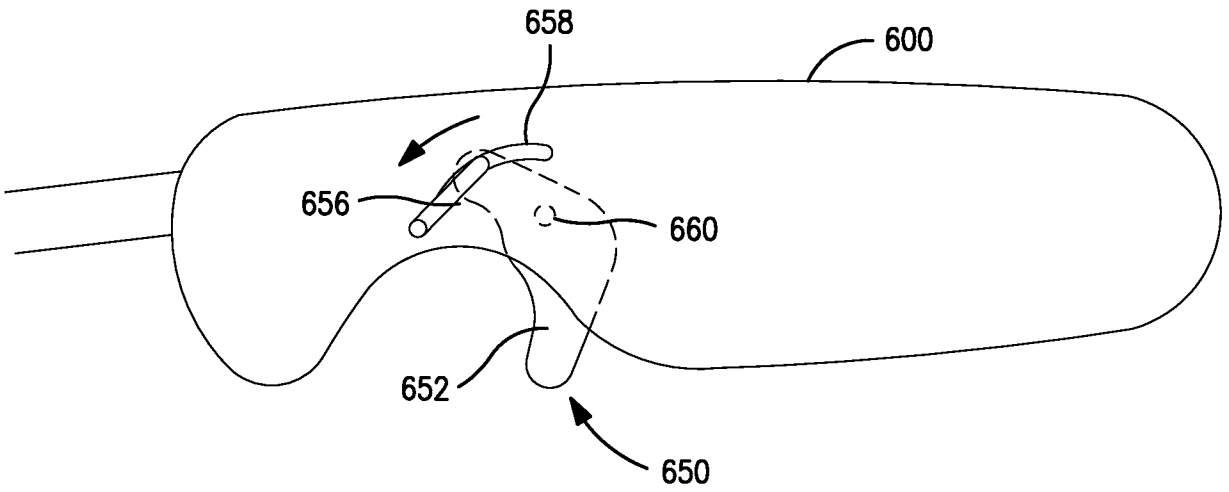
FIG. 7 Shows the embodiment of FIG. 5 in the ignition position.
Figure 8:
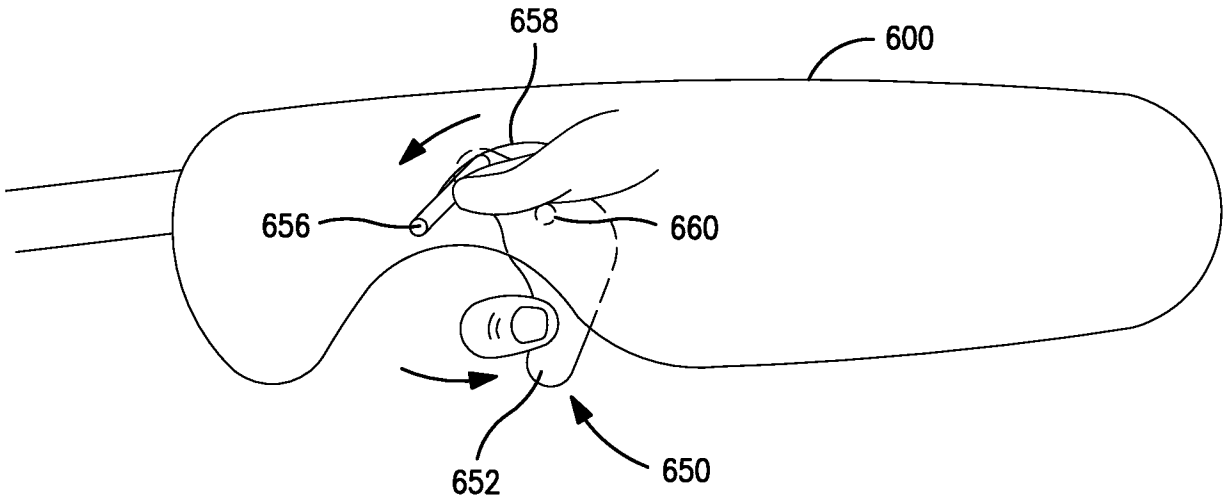
FIG. 8 is a similar view to FIG. 5 with the addition of location of the users fingers located on the two activating points on the activating unit at the start of the ignition process.
Figure 9:
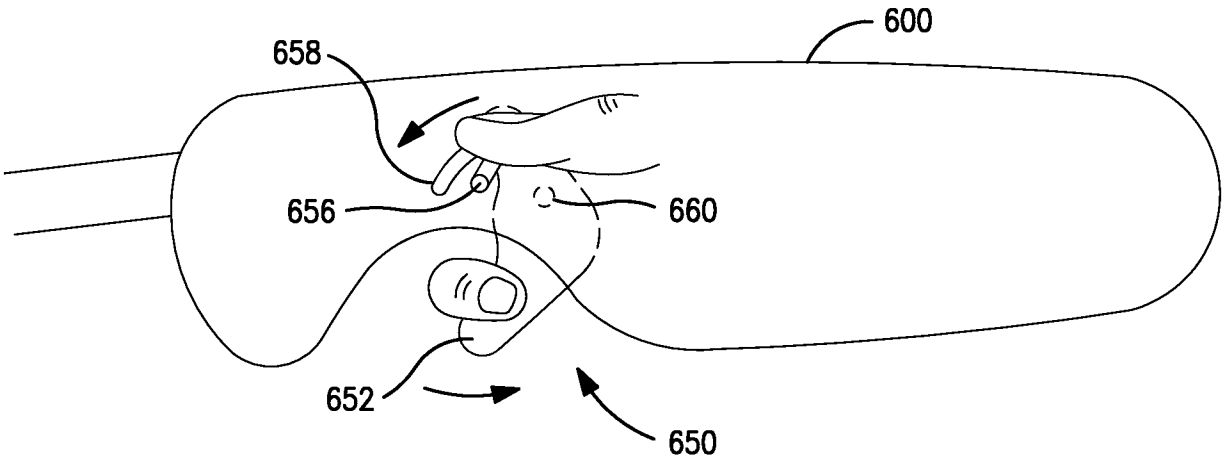
FIG. 9 a similar view to FIG. 7 with the addition of the users fingers located on the two activating points on the activating unit at the point of ignition.

FIG. 7 shows assembly 650 within housing 600 in an ignition position, wherein cam 652 has been pivoted about pivot point 660. It should be understood that cam 652 in this embodiment would likewise be biased by springs and the like within housing 100, the details of which are not repeated in this embodiment, in similar fashion to those which are discussed above with respect to the embodiment of FIGS. 1-4. Thus, the rest position for this embodiment would be as illustrated in FIG. 5 and FIGS. 8 and 9 illustrate positioning of fingers of an intended user which can be used to pivot assembly 650 from the initial position shown in FIGS. 5 and 9 to the ignition position shown in FIGS. 7 and 8.

It should be appreciated that rod 656 of this embodiment provides for a second surface to which force can be applied within the broad scope of the present invention as disclosed herein.

FIGS. 10 and 10A-D illustrate another embodiment which includes a push button 340 slidably connected to housing 100. Ribs 341 on push button 340 fit into slots in housing 100 (not shown) that allow push button 340 to slide in relation to the housing. Push button 340 has a pin 342 that fits into slot 351 on cam 350. As push button 340 is pushed by the intended user with one finger, pin 342 contacts a surface in slot 351 and a force/displacement is exerted on cam 350 to rotate cam 350 in a counter clock-wise direction at the same time the intended user can apply a force on lower exposed cam contact surface 350*b* with another finger to rotate cam 350. As cam 350 rotates, gas actuator contact surface 350*d* comes in contact and depresses gas actuator 120 to release gas from the fuel supply and piezo contact surface 350*c* depresses the piezo to create a spark to ignite the fuel.

Spring 170*c* is a coil spring located in a compressed state between protrusion 220 and surface 350*c* on cam 350 that increases the difficulty to rotate cam 350 and returns cam 350 to its initial position when released by the user. A pin 201 can be added to protrusion 200 to control the location of spring 170*c* on protrusion 220, or additional protrusions or recesses can be added to secure or engage on both sides of spring 170*c* as discussed above and as is known in the art.

Housing pin 325 prevents movement of cam 350 in a clockwise direction when cam 350 is in the initial position similarly to pin 225 in FIG. 1.

The shape of slot 351 and pin 342 are designed such that the sliding motion of push button 340 does not cause any significant binding or interference between slot 351 and pin 342 such as to prevent cam 350 from returning to the initial position once push button and cam 350 are release by the end user. In addition, when cam 350 is rotated without depressing push button 340, push button 340 does not move until the back edge of slot 351 comes in contact with pin 342.

Summarizing the embodiment of FIGS. 10 and 10A-D, this embodiment functions on the same concept as the embodiment of FIGS. 1-4, but utilizes an activating assembly comprising cam 350, push button 340 and the components interacting or linking push button 340 with cam 350 and the combination of pushbutton 340 and cam 350 with gas actuator 120 and igniter assembly 143.

FIG. 10. shows the lighter in this embodiment in an initial position, and a user can operate this embodiment as intended by applying a force to push button 340 and cam 350 such that the combined force is sufficient to move cam 350 within the housing and operate the internal mechanisms as desired.

Figure 10C:
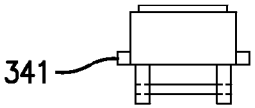
FIG. 10*c* is a front view of the part of the ignition unit FIG. 10B.
Figure 10B:
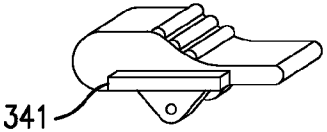
FIG. 10B is an isometric view of an alternative part of the ignition unit of FIG. 10.
Figure 10A:
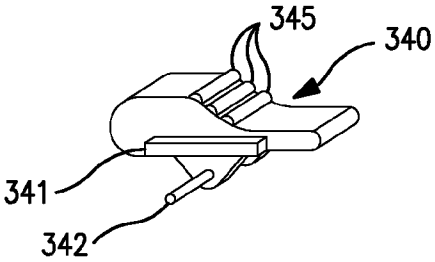
FIG. 10A is an isometric view of a part of the ignition unit of FIG. 10.
Figure 10:
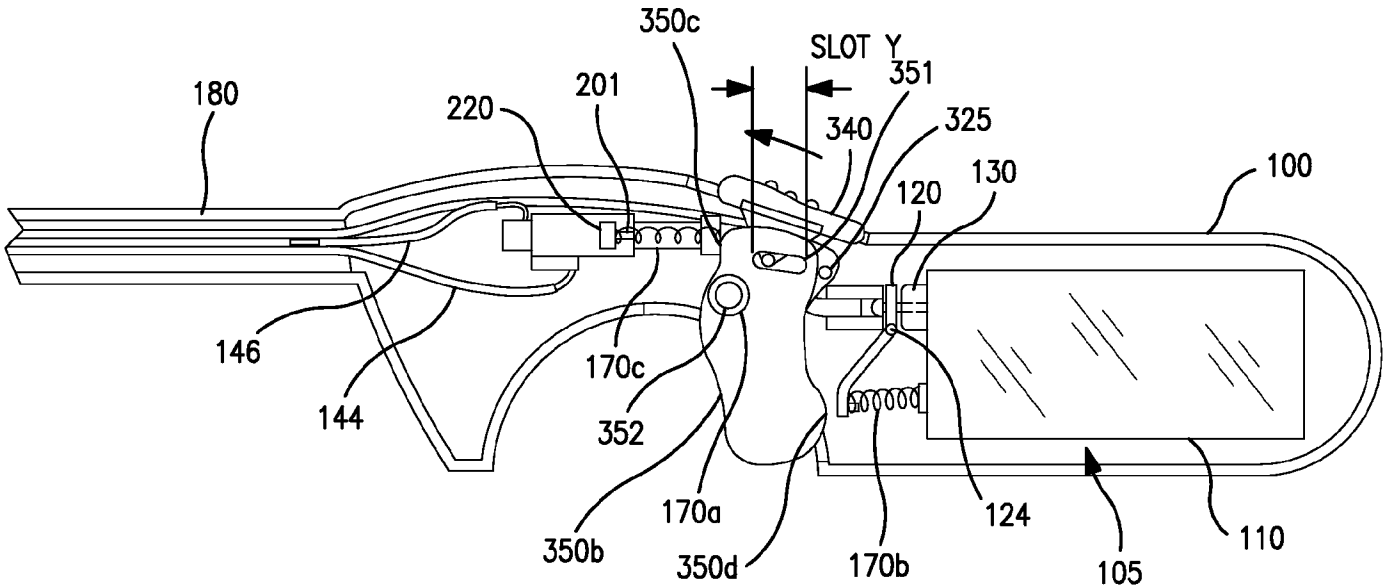
FIG. 10 is a cut away side view of a utility lighter of an alternative embodiment with some components removed for clarity and better illustrating various inner details, wherein the lighter is in an initial or at rest state.

FIGS. 10A-C further illustrate various views of push button 340 in accordance with this embodiment, and better show a lower structure of ribs 341 which hold pin 342 for interaction with slot 351 and cam 350.

This embodiment can be operated either with a force applied to both push button 340 and cam 350 as intended, or through application of a greater magnitude force for individuals with sufficient strength, to either push button 340 or cam 350.

Figure 10D:
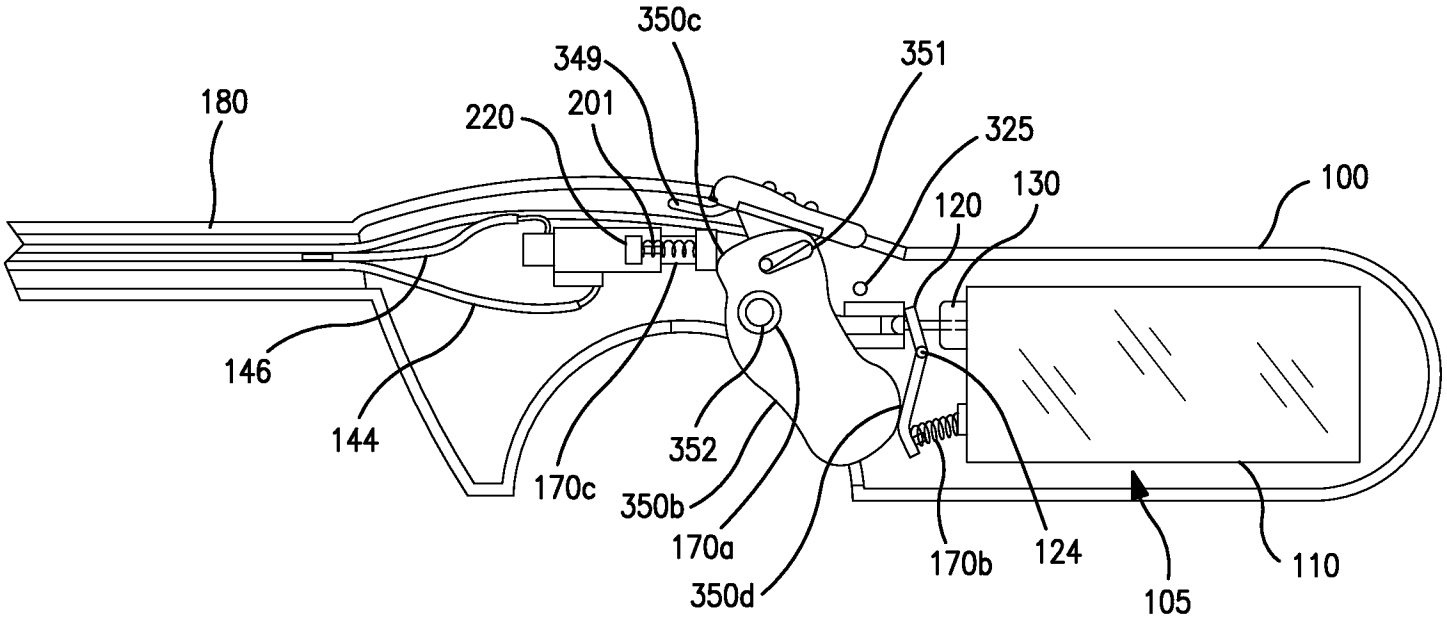
FIG. 10D illustrates the embodiment of FIG. 10 in the ignition position.

When sufficient force is applied, cam 350 will rotate within housing 100 in a counter-clockwise direction to the ignition position shown in FIG. 10D. In that position, surfaces 350*c* and 350*d* of cam 350 interact with the piezo mechanism, gas actuator 120, and the fuel supply unit, respectively, to cause ignition as desired.

When it is desired to extinguish the flame from the lighter, the user can release the force being applied to cam 350 and push button 340, and the internal springs such as springs 170*c* and 170*b* cause cam 350 to pivot in a clockwise direction back to the initial position of FIG. 10.

With respect to this and perhaps other embodiments of the present invention, it should be noted that after the lighter has been ignited, the flame can be maintained by continued force upon either of push button 340 or cam 350.

It should also be noted that with respect to this embodiment, slot 351 defines the amount of movement which can be imposed upon push button 340 before this movement exerts a force on cam 350. When moving from the initial position of FIG. 10 toward the ignition position of FIG. 10D, force exerted upon push button 340 does not have any effect on cam 350 until pin 342 reaches a front surface of slot 351. Further, the greater the size of slot 351, the further the push button 340 or cam 350 can move relative to the other before there is contact between the slot and pin 342. It may be desired to have a slot which is sufficiently large to allow some movement of push button 340 without any effect on cam 350, as this will help to avoid an unintended user connecting that there is some relationship between push button 340 and cam 350.

Figure 11:
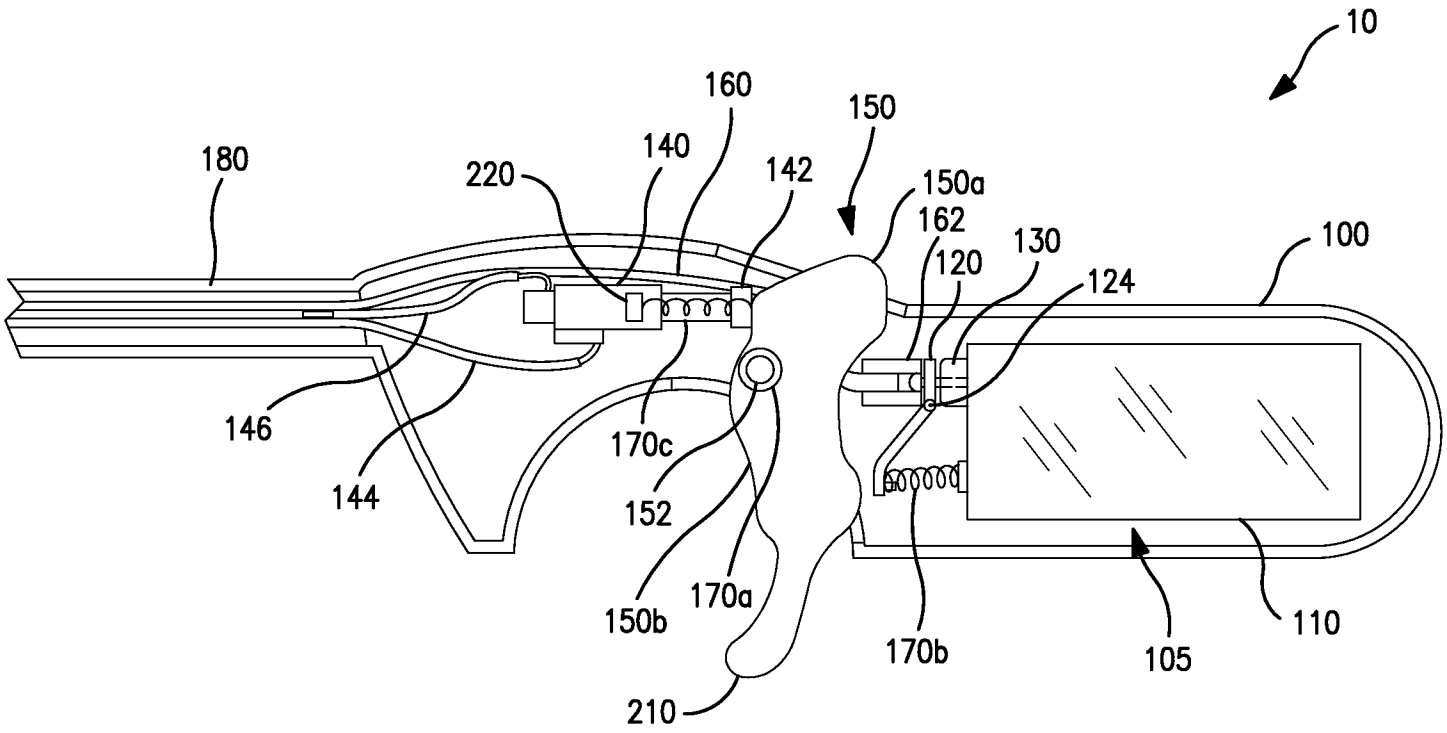
FIGS. 11 and 12 show an alternate embodiment having three (3) contact surfaces.
Figure 12:
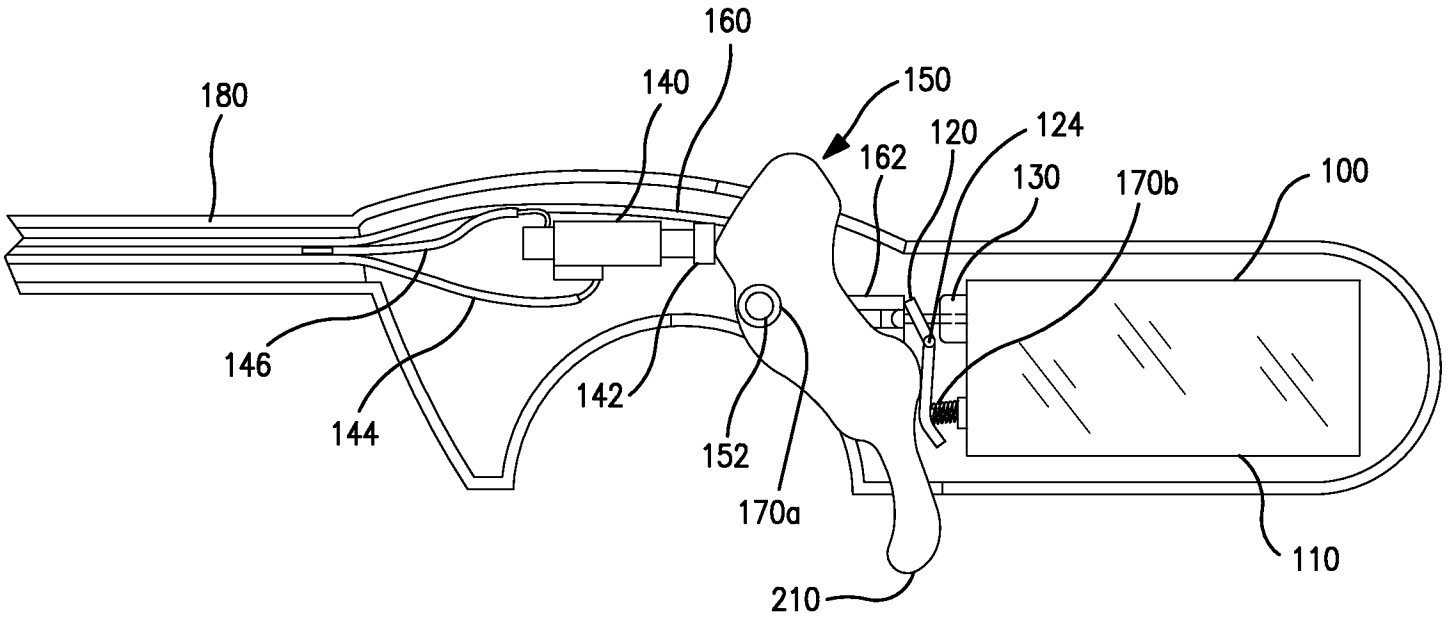

FIGS. 11 and 12 illustrate an embodiment of the present invention wherein a third surface is provided for operation using either a second finger in a different location or a third finger of the user, to help in supplying a sufficient force.

Aside from the shape of cam 150 as shown in FIGS. 11 and 12, the operation of the embodiment of these figures is substantially identical to that of FIGS. 1-4. In this embodiment, the key readily apparent difference is extension 210 which extends downwardly from cam 150 and creates the additional surface against which force can be applied by a user. Thus, in this embodiment, force can be applied by a user upon upper surface 150*a*, lower surface 150*b* and/or a front edge of extension 210. FIG. 12 shows the lighter of this embodiment in an ignition position, and makes readily apparent that once sufficient force is applied to cam 150, cam 150 rotates counter-clockwise in a similar fashion to the other embodiments to activate and ignite the lighter. Upon release of force to cam 150 including extension 210, cam 150 pivots clockwise back toward position of FIG. 11, and the flame of the lighter is extinguished.

Figure 13:
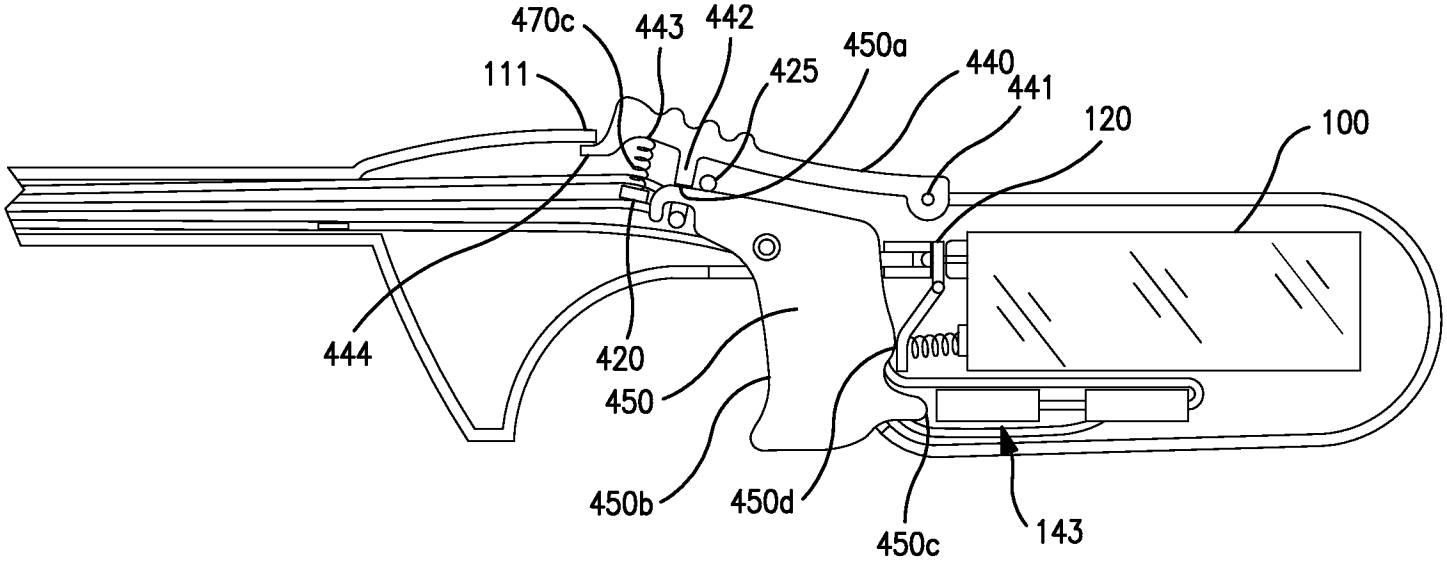
FIG. 13 is a cut away side view of a utility lighter of a further embodiment with some components removed for clarity and better illustrating various inner details, wherein the lighter is in an initial or at rest state.
Figure 14:
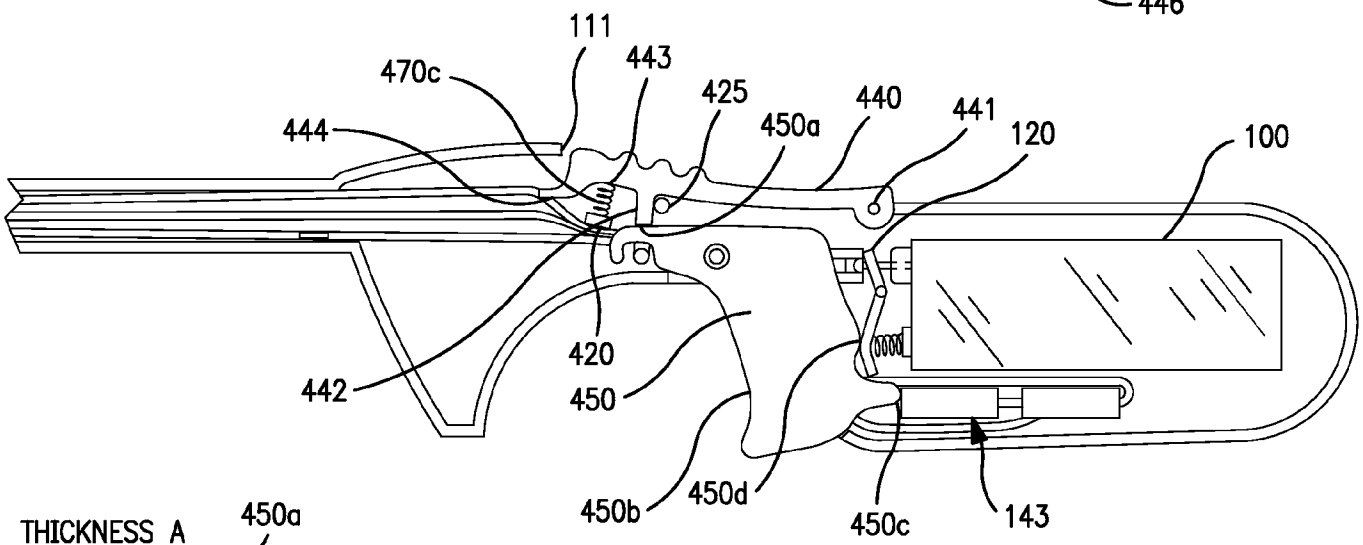
FIG. 14 illustrates the embodiment of FIG. 13 in the ignition position when depressing either both the push button and cam with more force being applied on the push button, or only the push button.
Figure 15:
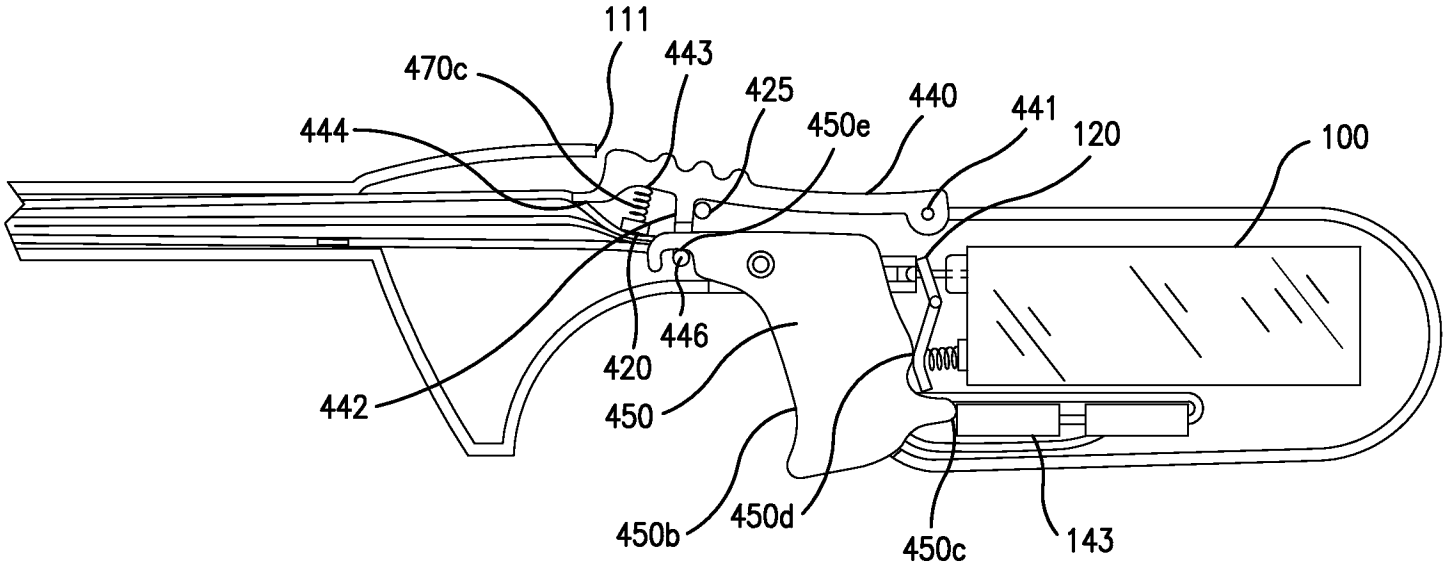
FIG. 15 illustrates the embodiment of FIG. 13 in the ignition position when depressing either both the cam only or the push button and cam with more force being applied on the cam.

In another embodiment, as shown in FIGS. 13-15, a push button 440 is pivotally connected at pivot 441 to housing 100. Push button 440 has a spring contact surface 443 and a protrusion 442. Spring 470*c* is a coil spring located in a compressed state between spring contact surface 443 of push button 440 and a rib or other structure 420 in housing 100. Optional spring 470*c* increases the difficulty to depress the push button 440 and returns push button 440 to its initial position when released by the user. As push button 440 is depressed by the intended user with one finger, protrusion 442 exerts force on surface 450*a* of cam 450 at the same time the intended user can apply a force on lower exposed cam contact surface 450*b* with another finger to rotate cam 450. As cam 450 rotates, gas actuator contact surface 450*d* comes in contact and depresses gas actuator 120 to release gas from the fuel supply, and piezo contact surface 450*c* depresses the piezo to create a spark to ignite the gas or fuel. When the user releases push button 440 and cam 450, spring 470*c* returns push button 440 and piezo 143 and gas actuator spring 470*b* also returns cam 450 to the initial position. Additional springs can be utilized to help return cam 450 if needed.

It should now be noted that pushbutton 440 could be configured as a cantilevered beam connected to the housing, and without the need for pivot 411. Resilience of the beam would allow the beam to flex and return as needed, and this resilience could also remove the need for spring 470*c*.

Figure 13A:
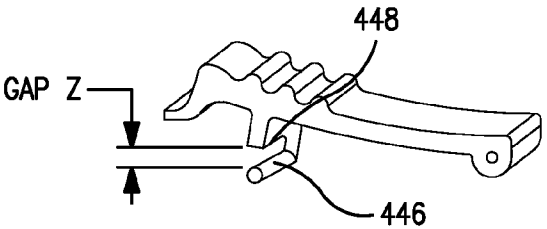
FIG. 13A illustrates a component of the embodiment of FIG. 13.
Figure 13B:
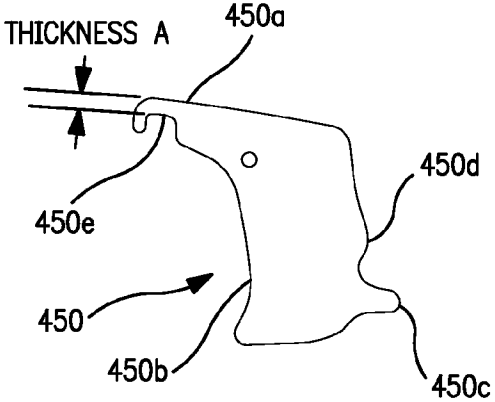
FIG. 13B further illustrates another component of the embodiment of FIG. 13.

It should be appreciated that protrusion 442 on pushbutton 440 can interact with cam 450 in several different ways. Further, it is desired in this embodiment, as with other embodiments, that there be some play between pushbutton 440 and cam 450 so that it was not readily apparent to unintended users that there is some connection between these two structures. FIG. 13A provides a detailed illustration of the structure of protrusion 442, and shows a lower pin 446 and an upper surface 448 separated by a gap Z. These structures interact with cam 450 in a location which is best illustrated in FIG. 13B, at contact surfaces 450*a* and 450*e*. These surfaces define a thickness A which fits between gap Z for example as shown in FIGS. 13 and 14, and the size of gap Z relative to thickness A provides for the desired amount of play between pushbutton 440 and cam 450. It should also be readily apparent that in this embodiment, if most or all force is applied to one or the other of pushbutton 440 and cam 450, there will be contact between these two components in different locations with respect to contact surfaces 450*a* and 450*e*, but that eventually both structures will move together as when they are both subjected to forces. Depending upon the force applied to pushbutton 440 and/or cam 450, one or the other of surfaces 450*a* and 450*e* will contact surface 448 or 446 respectively, of pushbutton 440. In other words, if excess force is applied to pushbutton 440, then surface 448 will contact surface 450*a* of cam 450, further movement will occur with these surfaces in contact. On the other hand, if excess more force is applied to cam 450, then surface 450*e* will contact surface 446 on pushbutton 440, further movement of these two components will occur with these two surfaces in contact. A further alternative situation can occur if substantially balanced forces are applied to both pushbutton 440 and cam 450 such that surfaces 450*a*, 450*e* float in gap Z between surfaces 448 and 446 without contacting either one. FIG. 13 illustrates this embodiment in an initial position, with springs rotating cam 450 fully clockwise and pushbutton 440 fully elevated. Housing 100 has a push button stop 111 (FIG. 13) and push button 440 can be provided with an extension 444 that work together to prevent push button 440 from rotating or otherwise coming out of housing 100.

FIG. 14 illustrates this embodiment in an ignition position which could be brought about through depressing either both of push button 440 and cam 450 with a higher force being applied to the push button than the cam or only push button 440. When force is exerted in this fashion, contact occurs between surface 448 of push button 440 and surface 450*a* of cam 450.

When operating the lighter of this embodiment by applying force only to cam 450 or to both cam 450 and push button 440 with a higher force being applied to cam 450 then than to push button 440 such that contact occurs between surface 446 of push button 440 and surface 450*e* of cam 450 as cam 450 pulls push button 440 along with it during its rotation to the ignition position illustrated in FIG. 15.

In either event, when it is desired to extinguish the flame in this embodiment, releasing push button 440 and cam 450 results in pivot of cam 450 rotating in a clockwise direction back to the initial position of FIG. 13, which prevents fuel from flowing and thereby extinguishes the flame.

Still referring to FIGS. 13-15, housing pin 425 can be positioned relative to cam 450 to prevent movement of cam 450 in a clockwise direction when cam 450 is in the initial position similarly to pin 225 in FIG. 1. Housing pin 425 which is preferably attached to housing 110 as a stop for Cam 450 (initial position, can also be positioned on cam 450 or on push button 440, or as a separate element there between, to assist in contact between these two components particularly when force is being applied to push button 440.

One of ordinary skill in the art will know and appreciate that the amount of force required may be varied by selecting different springs with a certain spring constant and/or modifying the geometry of camming surfaces of cam 150, as well as the location of center 152 in relation to the different contact points. As a result of this design, the force to rotate the cam 150 will also change.

The lighter is designed so that a user would have to possess a predetermined strength level in order to ignite the lighter. The lighter can also be ignited by the intended user with a single motion or a single finger by applying a greater force to one of the exposed surfaces 150*a* or 150*b*, and this can be referred to as a high force mode.

With respect to all embodiments, in order to make the lighter so that it is not excessively difficult for some intended users to actuate, the high force mode preferably should not be greater than a predetermined value. It is contemplated that for the lighters of this invention, the preferred value is less than about 10 kg and greater than about 5 kg, and more preferably less than about 8.5 kg and greater than about 6.5 kg. In other words, the total force necessary to be applied to the two contact surfaces, either in combination or entirely on one or the other, should be between about 5 and about 10 kg. It is believed that such a range of force would not substantially negatively affect use by some intended users, and yet would provide the desired resistance to operation by unintended users. These values are exemplary and the operative force in the high force mode may be more or less than the above ranges.

Alternatively, if the intended user does not wish to use the lighter by activating the lighter with one finger at one contact surface (high force mode), the intended user may operate the lighter by contacting multiple cam surfaces depending upon the embodiment, and applying force at both locations simultaneously requiring less force at any one location to activate the lighter and making it easier to operate. This mode of operation comprises multiple actuation movements, and in the embodiment shown, the user applies two or more forces/motions to move the cam 150, 350, 450, 650 and/or pushbutton 340, 440 or extending rod 656 with less force at any one surface than would need to be applied in the high force mode, and this can be referred to as the low force mode.

Preferably, in order to perform the low force mode, the user has to possess a predetermined level of dexterity, hand size and cognitive skills to move both exposed contact surfaces (150*a* and 150*b* for example) at the same time.

The present invention is not limited to the sequences disclosed but also includes such alternatives as contemplated by one of ordinary skill in the art. The unintended user safety features of lighter 10 in the low-force mode also may rely on the physical differences between intended and unintended users, for example, by controlling the spacing between the exposed surfaces of cam 150, 350, 450 (and/or push button 340/440) and/or adjusting the operation forces and displacements required to activate the lighter. The forces and displacements can be modified by adjusting each cam surface interaction, by adjusting the location of the center of cam 150, the shape of the cam surfaces (150*c* & 150*d*), the spring designs, etc. Further, Gaps Y, Z and thicknesses A & B can also be configured to optimize feel and/or the forces and displacements required to activate the lighter for intended and unintended users.

The design of the internal components and/or assemblies, for example the configuration of the actuating assembly or unit, the configuration of any linking mechanism, the number of springs and forces generated by the springs all affect the force which a user needs to apply to the actuating unit in order to operate the lighter. For example, the force requirements for a cam which moves along an actuation path may not equal the force requirements to move an actuating unit along a linear, rotational, non-linear, etc. actuation path. Actuation may require that a user move the actuating unit along multiple paths which may make actuation more difficult.

While the embodiments disclosed have shown preferred actuating units with a rotational actuation path, one of ordinary skill in the art can readily appreciate that a linear, rotational, and/or non-linear actuation, multiple paths, etc. are contemplated by the present invention.

One of ordinary skill in the art can readily appreciate that various factors can increase or decrease the force which an intended user can comfortably apply to the cam. These factors may include, for example, the leverage to push, pull or actuate the actuating unit provided by the lighter design, the friction and spring coefficients of the lighter components, the shape of the exposed cam surfaces, the cam shape, the complexity of the cam actuation motion, the location, size and shape of the components, intended speed of activation, etc. For example, the location and/or relationship between the cam exposed surfaces can be configured taking into account whether the user has large or small hands.

One feature of lighter 10 is that in the high-force mode single actuating point/operation may be performed so long as the user provides the necessary actuation force and displacement. Another feature of the lighter 10 is that in the low-force mode multiple actuating points/operations may be performed so long as the user applies enough force(s) and displacement(s) required at the exposed surfaces of cam 150 necessary to ignite the lighter. In particular, if the lighter does not operate on the first attempt, the user may re-attempt to produce a flame by actuating cam 150 by applying a force to either a single or to multiple actuation points which may require releasing the actuating unit for example to reset the piezo.

The lighter designs as shown in FIGS. 10-10*d*, 13-15 are also inherently tamper resistant because if the push button (340 or 440) was intentionally removed the lighter would be in high force mode i.e. the force to rotate Cam 350 or 450 to activate the lighter could exceed the level of child resistance required as springs 170*b*, 170*c* and the force to activate the ignition mechanism could be designed to create the necessary force for the lighter to be child resistant. If cam 350 or 450 was intentionally removed from the lighter, the lighter is then non-functional and cannot be operated because all the required surfaces to release the gas and activate the ignition mechanism would be removed from the product.

In all embodiments disclosed herein, lighter 10 has two activation surfaces that have to be moved in certain directions with enough force and displacement to ignite the lighter. This allows the adult user to apply forces at different points to the same component or assembly to overcome the forces to ignite the lighter. By locating the activation points of cam 150 such that two different fingers of the intended user can apply the force to ignite the lighter, the unintended user will have difficulty because they do not have the cognitive ability, dexterity, hand size, and/or strength to overcome the force to activate the lighter by only contacting one activation point, or may not be able to reach two or more activation points with a smaller hand size than an adult or intended user as well as apply enough force in the correct direction at the same time to activate the lighter.

Distance between the activating points can be designed such that it requires 2 hands to activate or a large hand to reach both activation points at the same time.

The lighter is preferably designed with a rotating cam with two separate activation points that can be contacted by an adult hand that requires a predetermined torque. For typical lever arm lengths of lighters of the type to which the invention, having lever arms between about 5 mm and about 50 mm, the predetermined torque is preferably less than 500 kg-mm and greater than 50 kg-mm. The two points would preferably be positioned for contact by the index finger and the thumb. The index finger can rotate cam 150, 350, 450 and the thumb can apply displace push button 340, 440 a predetermined distance to ignite the lighter as shown in FIGS. 10, 10*d*, & 13-15. Another example is shown in FIG. 3 where the index finger is applying a torque on the lower portion of cam 150, at surface 150*b* of FIG. 1, and simultaneously the thumb is applying a torque to the same cam 150, at surface 150*a* as shown in FIG. 1 (note similar surfaces on 350, 450 and/or push button 340, 440 in other embodiments) to overcome the torque (forces) to ignite the lighter as shown in FIG. 4.

As force is applied to cam 150, 350, 450 (and/or push button 340, 440), cam 150, 350, 450 (and/or push button 340, 440) rotates to depress (rotate) the gas actuator 120 and depress the piezo mechanism 143 as shown in FIGS. 3 & 4.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for the elements thereof without departing from the scope of the present disclosure. In addition, many modifications may be made to adapt a particular situation or material to the teachings of the disclosure not to be limited to the particular embodiment(s) disclosed as the best mode contemplated, but that the disclosure will include all embodiments falling therein.

The invention claimed is:

1. A lighter, comprising:

a housing having a supply of fuel;

an ignition mechanism for igniting fuel from the supply of fuel;

an activating unit movably associated with the housing to selectively ignite the fuel upon application of an activating force to the activating unit; and at least two separate contact areas exposed through separate openings in the housing to allow a user to use at least two fingers to apply forces to the contact areas which combined are greater than or equal to the activating force, wherein each of the at least two separate contact areas is operatively associated with the ignition mechanism such that force applied to either of the at least two separate contact areas activates the ignition mechanism and releases fuel from the supply of fuel such that released fuel is ignited by the ignition mechanism when activated and the fuel is selectively ignitable by applying the activating force through a first contact area of said at least two separate contact areas alone, by applying the activating force through a second contact area of said at least two contact areas alone, and by applying the activating force through a combination of the first contact area and the second contact area, and wherein the separate openings are spaced apart.

2. The lighter of claim 1, wherein the activating unit has at least one internal surface to release fuel from the supply of fuel.

3. The lighter of claim 1, wherein the activating unit has at least one internal surface to activate the ignition mechanism to ignite fuel.

4. The lighter of claim 1, wherein the activating unit has at least one internal surface to activate the ignition mechanism and to release fuel from the supply of fuel.

5. The lighter of claim 1, wherein the activating unit has at least one internal surface to activate the ignition mechanism to ignite fuel and at least one additional internal surface to release fuel from the supply of fuel.

6. The lighter of claim 1, wherein the activating unit rotates in relation to the housing.

7. The lighter of claim 1, wherein at least one part of the activating unit rotates in relation to the housing.

8. The lighter of claim 1, wherein at least one part of the activating unit moves in a linear motion.

9. The lighter of claim 1, wherein the at least two separate contact areas are exposed through different portions of the housing.

10. The lighter of claim 1, wherein the at least two separate contact areas are exposed through opposite sides of the housing.

11. The lighter of claim 1, wherein the at least two separate contact surfaces are defined on the activating unit.

12. The lighter of claim 1, wherein the activating unit comprises a one piece activating member movably associated with the housing such that application of the forces to the contact areas moves the activating member relative to the housing to selectively release and ignite the fuel.

13. The lighter of claim 1, wherein the activating unit comprises an activating assembly having at least a component which is movably associated with the housing and/or activating unit such that application of the forces to the contact areas moves the activating unit relative to the housing and/or activating unit to selectively release and ignite the fuel.

14. The lighter of claim 13, wherein the activating assembly comprises at least two movable components engaged with each other with a linkage.

15. The lighter of claim 14, wherein the linkage provides some movement of one of the at least two movable components without movement of the other of the at least two moveable components.

16. The lighter of claim 14, wherein the at least two movable components include a cam member rotatably mounted in the housing and a pushbutton movably mounted relative to the housing, the pushbutton being engaged with the cam member through the linkage.

17. The lighter of claim 1, wherein the lighter further comprises a nozzle, wherein the supply of fuel feeds fuel to the nozzle when activated by the activating unit, wherein the ignition mechanism ignites fuel at the nozzle, and wherein the ignition mechanism is activated by the activating unit.

18. The lighter of claim 17, wherein the supply of fuel and the ignition member each require a force component to be applied to the activating unit to be activated, and wherein the force component of the supply of fuel combined with the force component of the spark generating member is a portion of the activating force.

19. The lighter of claim 1, further comprising an additional force imposing member which imposes an additional force which must be overcome by the activating unit to release and ignite the fuel.

20. The lighter of claim 19, wherein the additional force imposing member comprises at least one spring opposing an activating movement of the activating unit relative to the housing.

21. The lighter of claim 1, wherein the housing has a handle portion and wherein the at least two separate contact areas comprise the first contact area extending from a bottom portion of the handle and the second contact area extending from a different portion of the handle.

22. The lighter of claim 1, wherein the housing has a handle portion and wherein the at least two separate contact areas comprise the first contact area extending from a bottom portion of the handle and the second contact area extending from a top portion of the handle.

23. The lighter of claim 1, wherein the activating unit is moveable relative to the housing from a first position to a second position wherein the activating unit causes ignition of fuel supplied from the supply of fuel.

24. The lighter of claim 1, wherein the activating unit is adapted to require an activating force of between 5 and 20 kg.

25. The lighter of claim 1, wherein the activating unit is adapted to require an activating force of between 6.5 kg and 15 kg.

26. The lighter of claim 1, wherein the activating unit is adapted to require an activating torque of between 50 kg-mm and 500 kg-mm.

27. The lighter of claim 1, wherein force applied to either of the at least two separate contact areas activates the ignition mechanism and releases fuel from the supply of fuel at the same time.

28. A method for igniting a lighter having a housing having a supply of fuel; an ignition mechanism for igniting fuel from the supply of fuel; an activating unit movably associated with the housing to selectively ignite the fuel upon application of an activating force to the activating unit; and at least two separate contact areas exposed through separate openings of the housing to allow a user to use at least two fingers to apply forces to the contact areas which combined are greater than or equal to the activating force, wherein each of the at least two separate contact areas is operatively associated with the ignition mechanism such that force applied to either of the at least two separate contact areas activates the ignition mechanism and releases fuel from the supply of fuel such that released fuel is ignited by the ignition mechanism when activated and the fuel is selectively ignitable by applying the activating force through a first contact area of said at least two separate contact areas alone, by applying the activating force through a second contact area of said at least two contact areas alone, and by applying the activating force through a combination of the first contact area and the second contact area, comprising applying a force to each of the at least two separate contact areas to apply a combined force to the activating unit which is greater than or equal to the activating force, whereby fuel is released from the supply of fuel and ignited by the ignition mechanism, and wherein the separate openings are spaced apart.

29. The method of claim 28, wherein force applied to either of the at least two separate contact areas activates the ignition mechanism and releases fuel from the supply of fuel at the same time.

* * * * *